US007481253B2

(12) United States Patent
Hummel

(10) Patent No.: US 7,481,253 B2
(45) Date of Patent: Jan. 27, 2009

(54) ADJUSTABLE SCALE AND ROUTER TABLE FOR USE THEREWITH

(75) Inventor: Richard M. Hummel, Parma, OH (US)

(73) Assignee: Woodpeckers, Inc., North Royalton, OH (US)

( * ) Notice: Subject to any disclaimer, the term of this patent is extended or adjusted under 35 U.S.C. 154(b) by 149 days.

(21) Appl. No.: 11/541,761

(22) Filed: Oct. 2, 2006

(65) Prior Publication Data

US 2008/0078472 A1 Apr. 3, 2008

(51) Int. Cl.
*B25H 1/00* (2006.01)
*B27C 5/02* (2006.01)

(52) U.S. Cl. ..... 144/136.95; 144/286.5

(58) Field of Classification Search ..... 144/136.95, 144/154.5, 286.5, 286.1, 287; 409/182
See application file for complete search history.

(56) References Cited

U.S. PATENT DOCUMENTS 5,139,061 A * 8/1992 Neilson ..... 144/135.2
6,505,659 B1 * 1/2003 Hummel ..... 144/135.2
6,550,154 B1 * 4/2003 Smith ..... 33/638
6,739,066 B2 * 5/2004 Smith ..... 33/638
6,948,892 B2 * 9/2005 Hummel ..... 409/182
6,966,122 B2 * 11/2005 Smith ..... 33/638
6,991,008 B2 * 1/2006 McDonald et al. ..... 144/136.95
2007/0235106 A1 * 10/2007 Hummel ..... 144/286.1

* cited by examiner

*Primary Examiner*—Shelley Self
(74) *Attorney, Agent, or Firm*—Sand & Sebolt

(57) ABSTRACT

An adjustable scale typically used with a router table may be reset at any time to facilitate determining the change in height of the router regardless of where the scale is positioned when the router is at a given height. When used with a router table having a table plate with a height adjustment screw for adjusting the height of the router, the scale includes a marker carried by the table plate or the adjustment screw. When carried by the adjustment screw, the marker is rotatable relative to the adjustment screw to align markings thereon with a reference mark on the table plate to reset the scale. Thus, a zero marking may be aligned with the reference mark at any height of the router, and the adjustment screw and marker may then be rotated together to adjust the height of the router and simultaneously measure the height change.

32 Claims, 7 Drawing Sheets

ADJUSTABLE SCALE AND ROUTER TABLE FOR USE THEREWITH

BACKGROUND OF THE INVENTION

1. Technical Field

The invention relates generally to a scale for measuring the distance an object has moved. More particularly, the scale is used for measuring the distance that such an object moves in response to rotation of an adjusting screw. Specifically, the scale is adjustable so that it may be reset to a reference point regardless of the position of the adjustment screw.

2. Background Information

Router tables and the like typically utilize an adjustment screw for adjusting the height of the carriage and router carried thereby relative to the work surface of the table. It is known in the art to include a scale on the adjustment screw which has markings which are alignable with a reference point or mark on the table in order to determine the change in height of the router as the adjustment screw is rotated. However, a problem that arises with the use of such scales is the need to track and calculate the height adjustment between two positions as the adjustment screw is rotated. That is, when the markings of the scale are not zeroed to the reference point when beginning a height adjustment, the user is required to subtract numbers which may easily cause user error. In addition, when the reference point is positioned between an adjacent pair of markings on the scale, it is more difficult to ascertain the exact starting position of the adjustment screw and thus the exact height of the router or the like. Thus, beginning a height adjustment at such an "in between" position of the markings, the calculation of the height adjustment becomes more difficult.

BRIEF SUMMARY OF THE INVENTION

The present invention provides an apparatus comprising a first table plate member defining a through hole adapted to receive a rotary cutting member of a rotary cutter; a first threaded member rotatably mounted on the table plate member; a carriage which is adapted to carry the rotary cutter and which threadedly engages the first threaded member and is movable toward or away from the table plate member in response to rotation of the first threaded member; a marker carried by and selectively rotatable relative to one of the first members; a reference mark on one of the marker and the first member not carrying the marker; a plurality of markings on the other of the marker and the first member not carrying the marker.

The present invention further provides a method comprising the steps of moving a marker relative to a first table plate member defining a rotary cutter member-receiving through hole and a first threaded member rotatably mounted on the first table plate member to align a first mark carried by the marker with a second mark carried by the first member not carrying the marker; and rotating the first threaded member to move a rotary cutter carriage threadedly engaged with the first threaded member toward or away from the first table plate member and to position a third mark on one of the marker and first member not carrying the marker adjacent the mark carried by the other of the marker and first member not carrying the marker.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
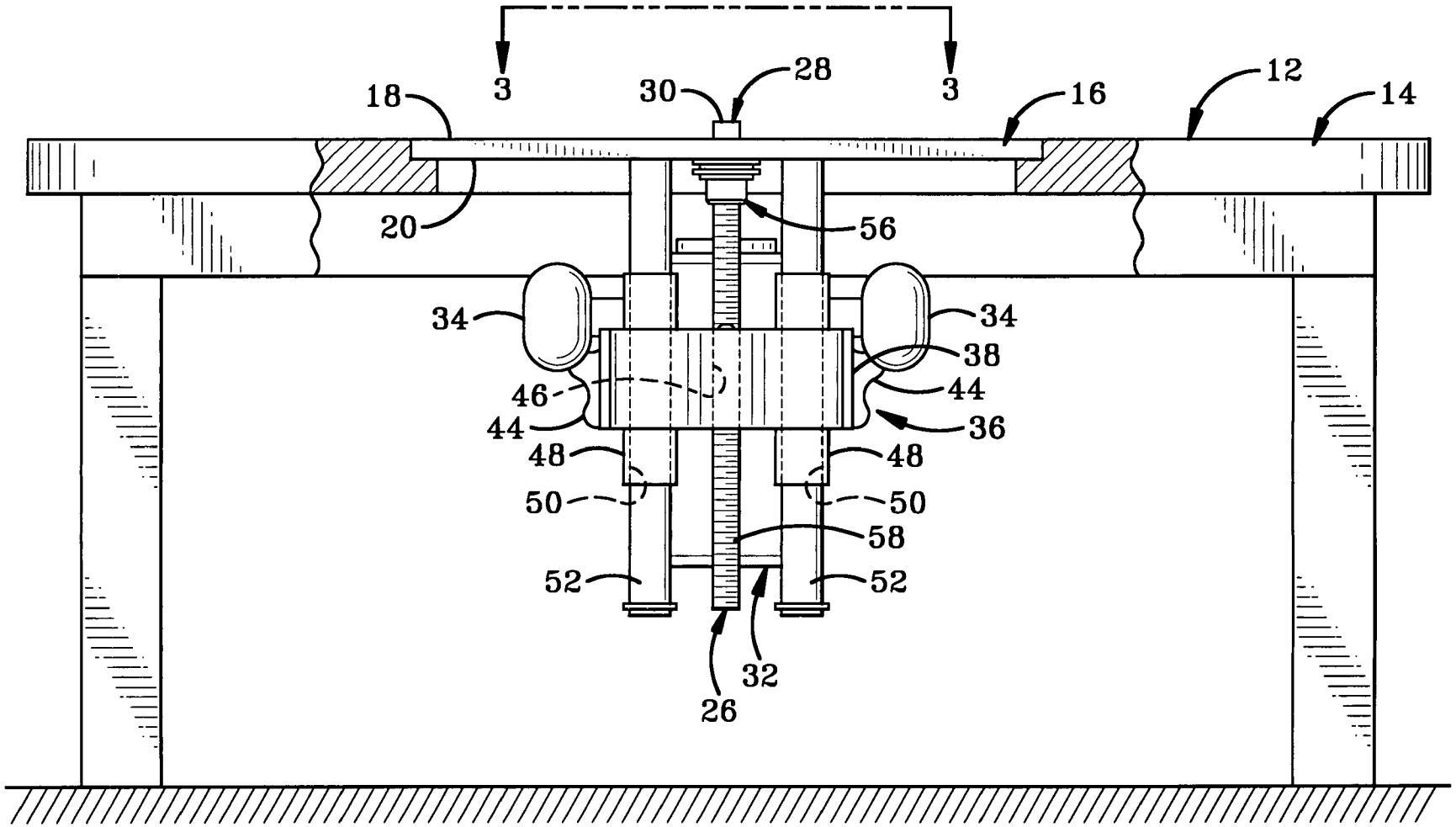
FIG. 1 is a front elevational view with portions cut away of a router table and a router mounted thereon with which the adjustable scale of the present invention is used.
Figure 2:
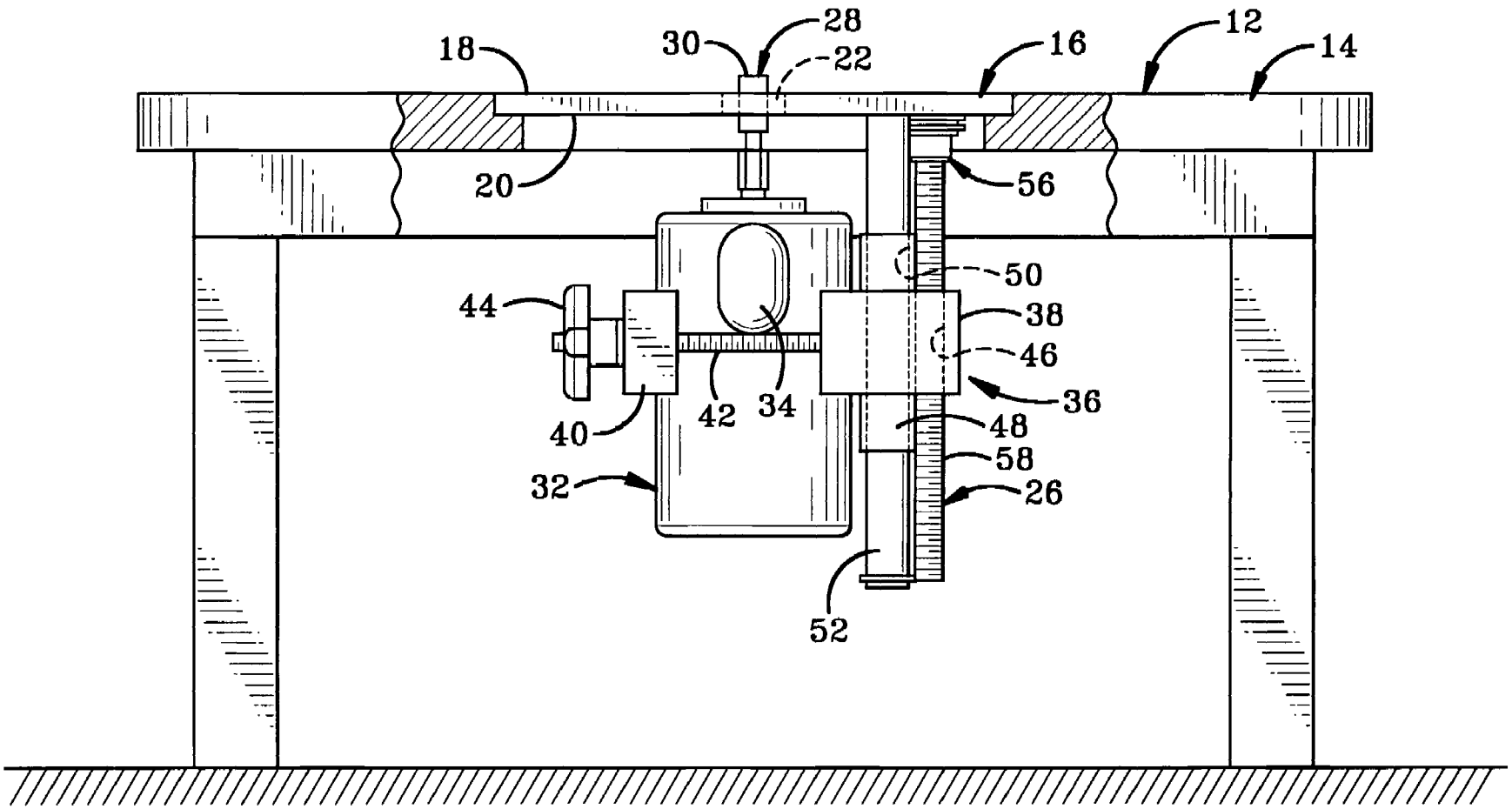
FIG. 2 is a side elevational view with portions cut away of the router table and router of FIG. 1.
Figure 3:
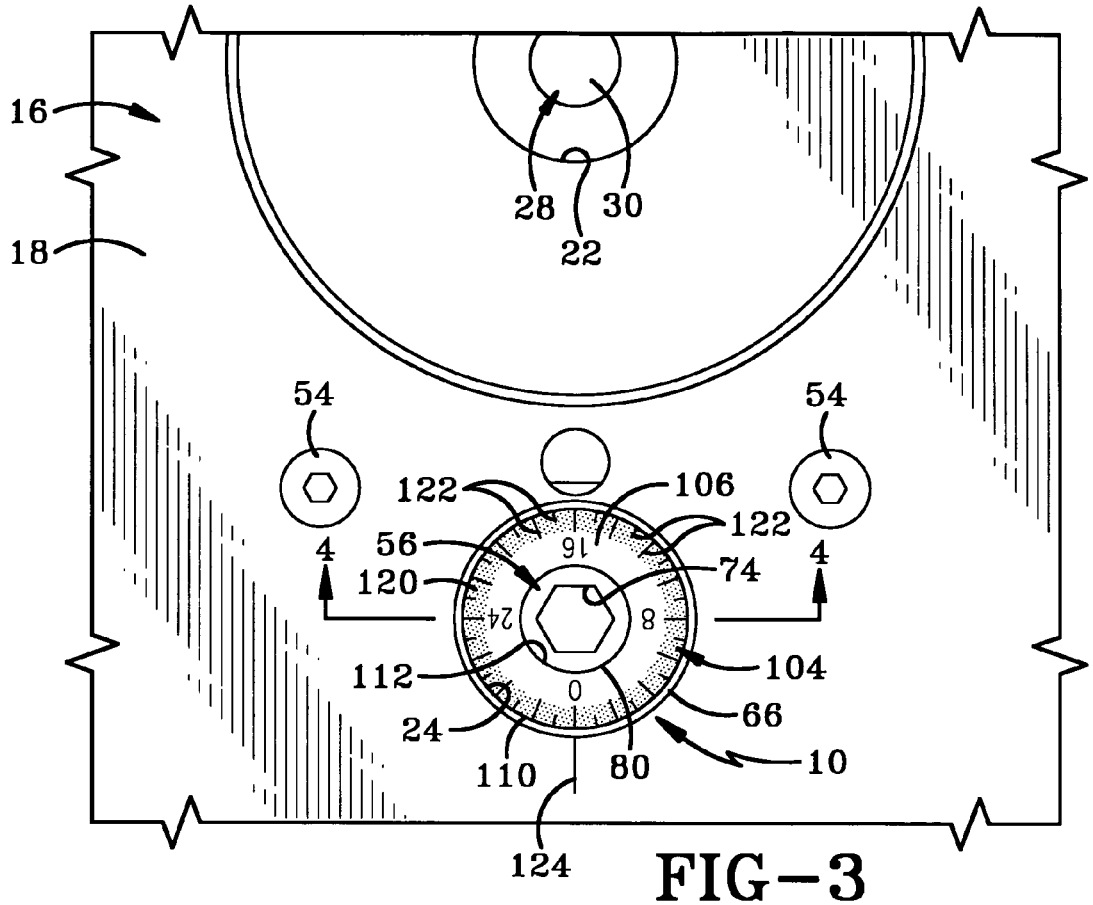
FIG. 3 is a sectional view taken on line 3-3 of FIG. 1.
Figure 4:
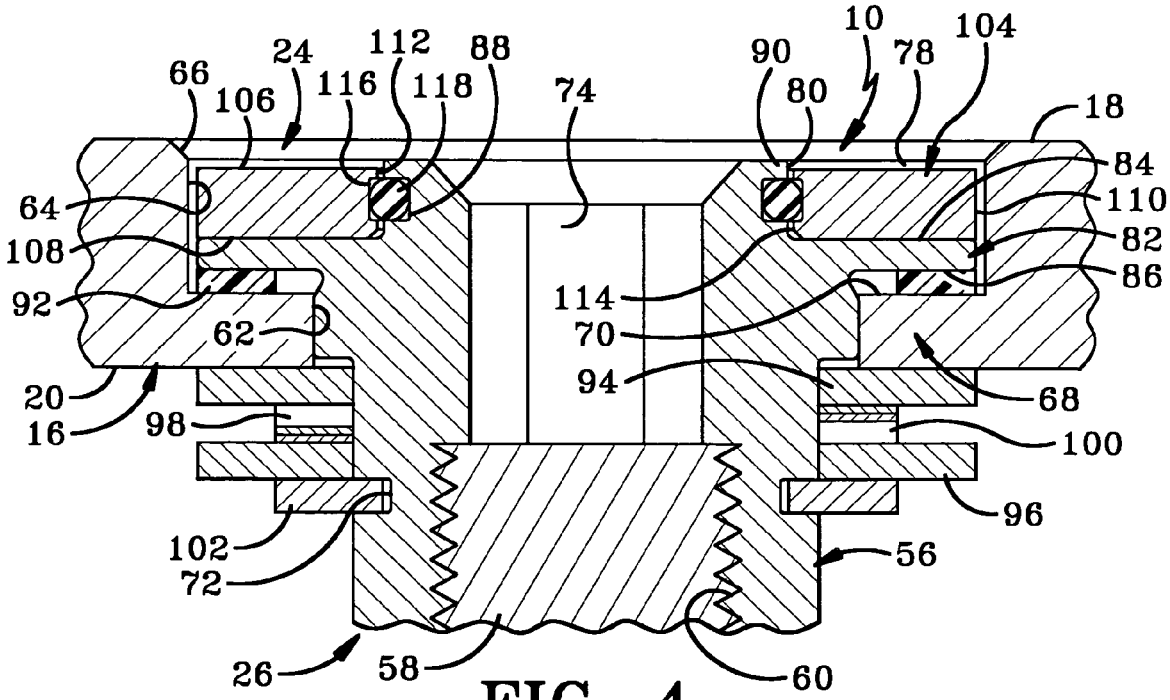
FIG. 4 is a sectional view taken on line 4-4 of FIG. 3.
Figure 8:
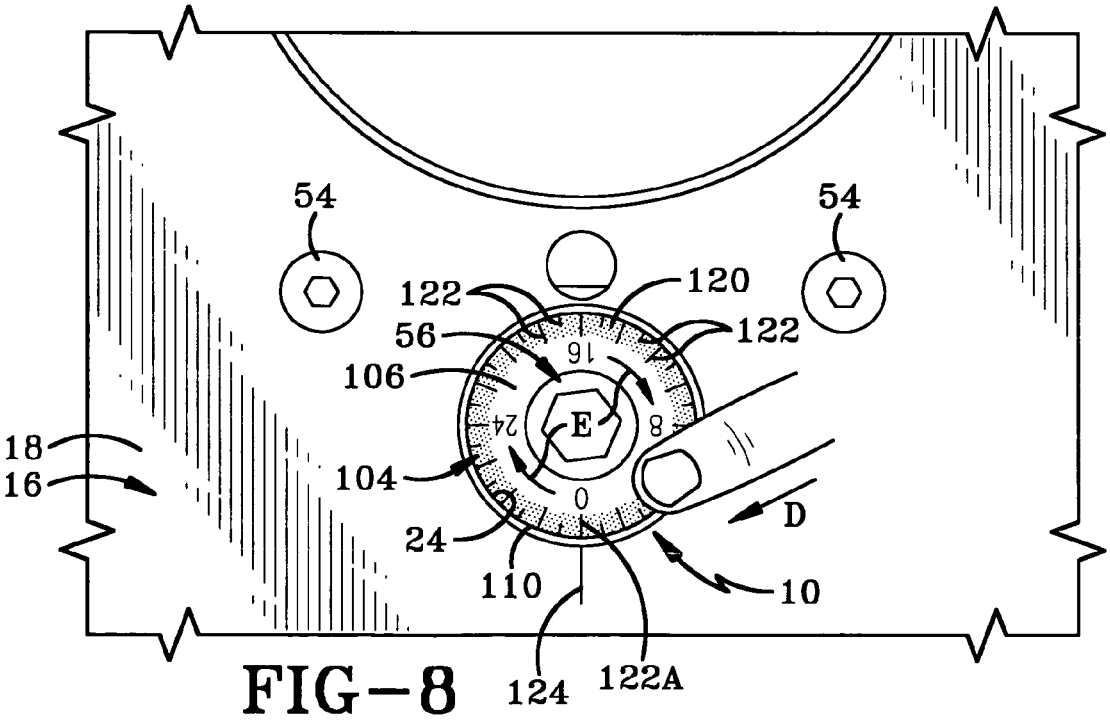
FIG. 8 is similar to FIG. 5 and shows a manual adjustment of the scale to reset the zero marking at the reference mark while the router is at the first height.

The adjustable scale of the present invention is shown generally at 10 in FIGS. 3, 4 and 8 in use with a router table 12 shown in FIGS. 1 and 2. Referring to FIGS. 1 and 2, router table 12 includes a plurality of legs supporting a table top 14 and a table plate 16. Table top 14 and table plate 16 have an upper side each of which is flat and coplanar to define a work surface 18 which is substantially horizontal. Table plate 16 has a lower side 20 and defines a bit-receiving through hole 22 (FIGS. 2-3) extending from the upper side to the lower side thereof. Table plate 16 further defines a second through hole 24 (FIGS. 3-4) extending from the upper to the lower side thereof for receiving therein a portion of an adjustment screw 26. Hole 22 receives therein a cutting member in the form of a cutter bit 28 having an upper surface 30. Cutter bit 28 is rotatably mounted on a router 32 having an electric motor for powering rotation of bit 22. Router 32 includes a pair of handles 34 extending outwardly from the body thereof. Router 32 is mounted on a carriage 36 comprising first and second clamping members 38 and 40, a threaded rod 42 extending therebetween and a handle 44 threadably engaging rod 42 and rotatable to tighten and loosen the clamping members to clamp router 32 therebetween or release said clamping thereof. Clamping member 38 defines an internally threaded hole 46 and includes a pair of elongated bushings 48 defining through holes 50 for receiving therein a respective pair of guide bars 52 on which bushings 48 are slidably mounted. Guide bars 52 extend downwardly from table plate 16 and are rigidly mounted thereon by mounting screws 54 (FIG. 3).

Referring to FIGS. 3 and 4, adjustment screw 26 includes a cap 56 which is disposed in hole 24 and an externally threaded rod 58 mounted thereon. More particularly, cap 56 defines an internally threaded hole 60 extending upwardly from the lower end thereof which threadably engages the upper end of rod 58 so that rod 58 is rigidly mounted on cap 56. Hole 24 in table plate 16 includes a lower narrower portion 62, a wider counterbore portion 64 and a beveled countersunk portion 66. Table plate 16 includes an annular flange 68 which extends radially inwardly from a body of plate 16. Flange 68 has an inwardly facing surface bounding lower portion 62 and an upper horizontal ledge 70 which bounds wider portion 64. Flange 68 typically includes a bushing (not shown) which bounds narrower portion 62. Cap 56 is rotatably mounted within hole 24 about a substantially vertical axis and includes a portion which slidably engages the inner surface of flange 68 during rotation thereof. Cap 56 defines an annular recess or groove 72 extending inwardly from the outer surface thereof and spaced downwardly from lower side 20 of table plate 16. Cap 56 has a tool engaging portion in the form of a hexagonally-shaped opening 74 which is accessible from the upper side of table plate 16 and configured to receive a mating hexagonal portion of a tool in the form of a handle 76 (FIGS. 5-6) used for rotating adjustment screw 26. Cap 56 defines an annular recess 78 which extends downwardly from the upper end thereof and circumscribes an upper portion of cap 56 and a portion of opening 74. Recess 78 has a substantially rectangular configuration as viewed from the side and is bounded in part by an annular surface 80 which extends vertically downwardly from the upper end of cap 56 and faces radially outwardly. An annular flange 82 extends radially outwardly from surface 80 and includes upper and lower annular surfaces 84 and 86 each of which is substantially horizontal, with upper surface 84 bounding recess 78. Flange 82 is disposed in wider portion 64 of hole 24 above flange 68. Cap 56 further defines an annular recess or groove 88 which extends inwardly from annular surface 80 so that an annular lip 90 overhangs groove 88 adjacent the upper end of cap 56.

Referring to FIG. 4, a washer 92 is seated on ledge 70 of flange 68 within wider portion 64 of hole 24. Lower surface 86 of flange 82 is seated atop washer 92 and slidably engages washer 92 during rotation of cap 56. Thus, washer 92 is typically formed of a plastic or other type of material which is relatively slippery and has a smooth outer surface to facilitate rotation of cap 56. The portion of cap 56 which extends below table plate 16 passes through several washers, including a washer 94 which abuts lower side 20 of table plate 16, a washer 96 spaced therebelow and first and second spring washers 98 and 100 disposed between washers 94 and 96 to provide a downward force on cap 56 via a spring bias. A retaining ring 102 abuts washer 96 and is disposed in annular groove 72 of cap 56 in order to retain adjustment screw 26 on table plate 16 while allowing it to rotate within hole 24.

In accordance with the invention and referring to FIGS. 3-4, adjustable scale 10 includes a substantially flat annular marker 104 which is disposed in annular recess 78 and wider portion 64 of hole 24 so that it is rotatably mounted on cap 56. Marker 104 has a substantially rectangular cross section which is slightly smaller than that of recess 78. Marker 104 has substantially flat and horizontal upper and lower surfaces 106 and 108. Upper surface 106 is disposed below work surface 18 a short distance so that upper surface 106 is manually accessible from the upper side of table plate 16. Lower surface 108 slidably engages upper surface 84 of flange 82 during relative rotation between marker 104 and cap 56. Marker 104 has a circular outer circumference or surface 110 defining a diameter of marker 104 which is slightly smaller than the diameter of wider portion 64 so that outer surface 110 is spaced slightly inwardly from the portion of table plate 16 defining wider portion 64. Marker 104 also has a circular inner circumference or surface 112 defining a through hole 114 which receives therein the portion of cap 56 circumscribed by annular surface 80 thereof. Marker 104 thus also circumscribes a portion of opening 74. Marker 104 further defines an annular recess or groove 116 which extends outwardly from inner surface 112. A frictional engagement member in the form of an O-ring 118 is disposed partially within groove 116 and partially within groove 88 so that O-ring 118 engages each of cap 56 and marker 104. O-ring 118 thus provides for a frictional engagement with marker 104 to maintain marker 104 in a fixed relation with respect to cap 56 unless a sufficient force is applied to marker 104 to overcome the frictional engagement with O-ring 116 and thus allow the rotation of marker 104 relative to cap 56, during which marker 104 slidably engages O-ring 118. Marker 104 and screw 26 rotate about a common axis. O-ring 118 is typically formed of an elastomeric material or another material which has sufficient flexibility and resilience to allow it to stretch over lip 90 and retract into groove 88. These characteristics also allow marker 104 to be press fit into place within recess 78 such that the lip of marker 104 disposed below groove 116 forces O-ring 118 inwardly during assembly with O-ring 118 subsequently expanding into groove 116 to mount marker 104 on cap 56.

Referring to FIG. 3, upper surface 106 of marker 104 adjacent outer surface 110 is preferably knurled as indicated by the shading at 120 in order to provide a rough surface to facilitate manual rotation of marker 104. A plurality of markings 122 are evenly circumferentially spaced along the outer circumference of marker 104 and include four markings which are specifically number "0", "8", "16" and "24". While the markings may represent a variety of specific measurements, typically they represent thousands of an inch as it relates to the height change of carriage 36 and router 32 during rotation of adjustment screw 26. Markings 122 are alignable with a reference point or mark 124 disposed on work surface 118 of table plate 16.

Figure 5:
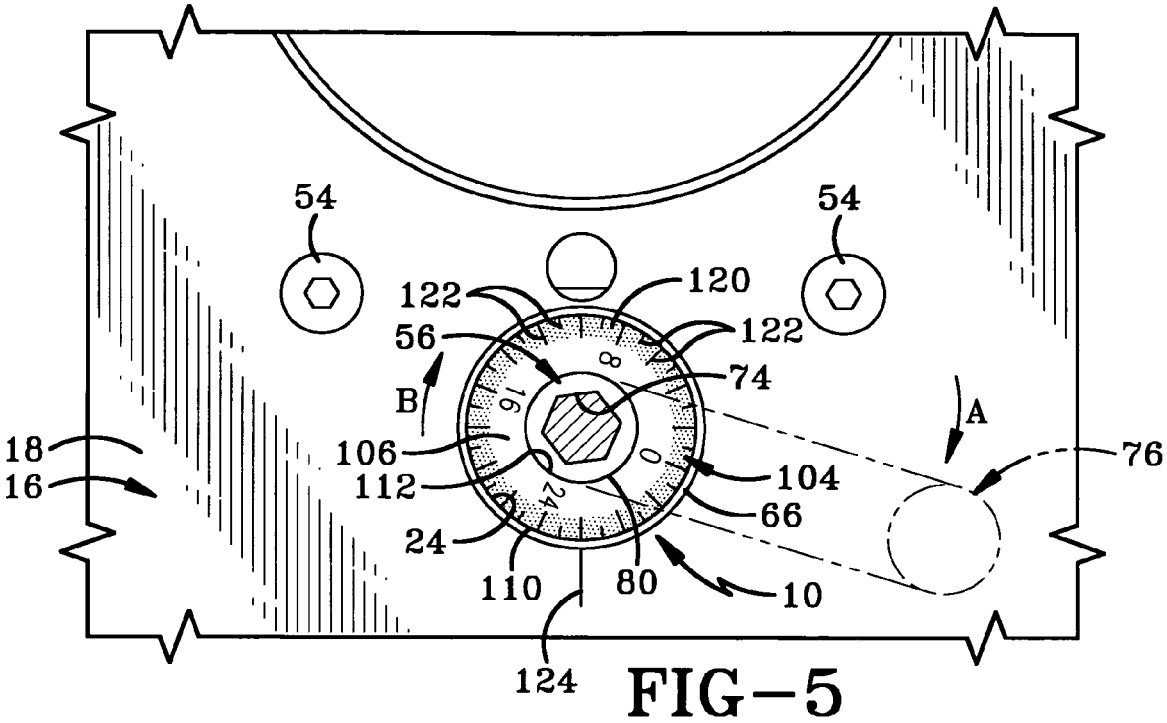
FIG. 5 is similar to FIG. 3 and shows a handle rotating the adjustment screw and adjustable scale.
Figure 6:
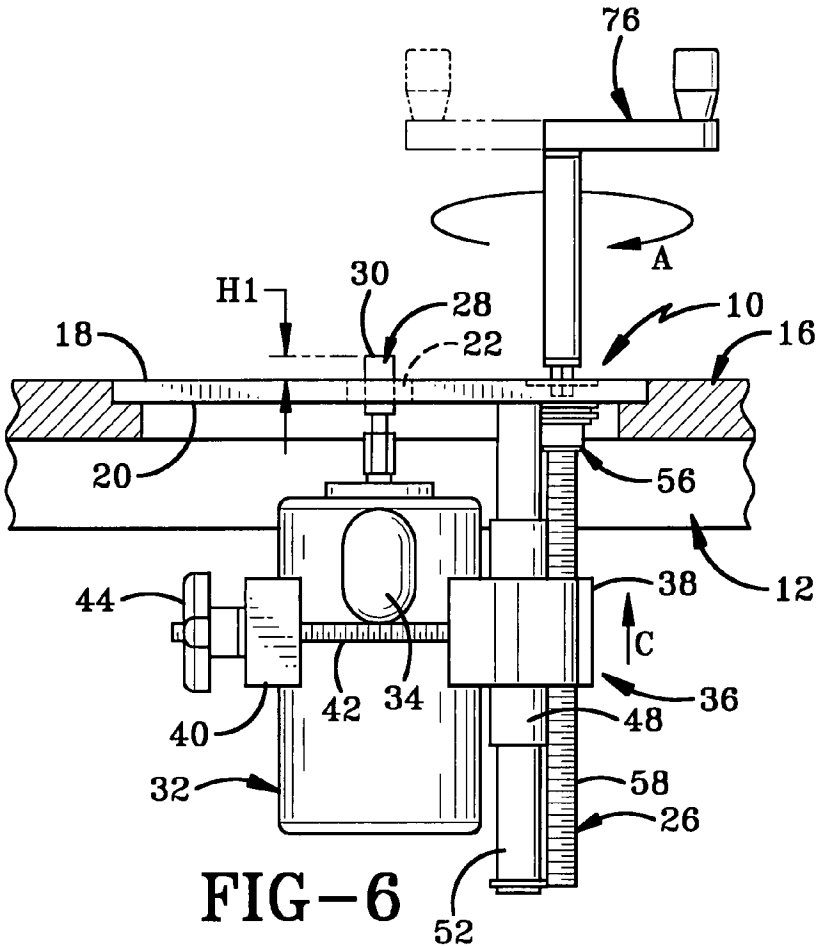
FIG. 6 is a fragmentary side elevational view similar to FIG. 2 showing the handle rotating the adjustment screw to move the router to a first height.

The operation of adjustable scale 10 is now described with reference to FIGS. 5-11. Referring to FIGS. 5 and 6, handle 76 is rotated as indicated at Arrows A to rotate adjustment screw 26 and marker 104 as indicated at Arrow B to raise carriage 36 and router 32 as indicated at Arrow C so that upper surface 30 of bit 28 is disposed at a first height H1 above work surface 18. This rotation of adjustment screw 26 and marker 104 has caused marker 104 to move from the position shown in FIG. 3 in which the "0" marking 122 is aligned with mark 124 to the position shown in FIG. 5 in which a marking 122 which would be associated with "26" if numbered is aligned with mark 124, thus indicating that carriage 36, router 32 and cutter bit 28 have been raised $^{26}/_{1000}$ of an inch, assuming less than one full rotation.

Figure 7:
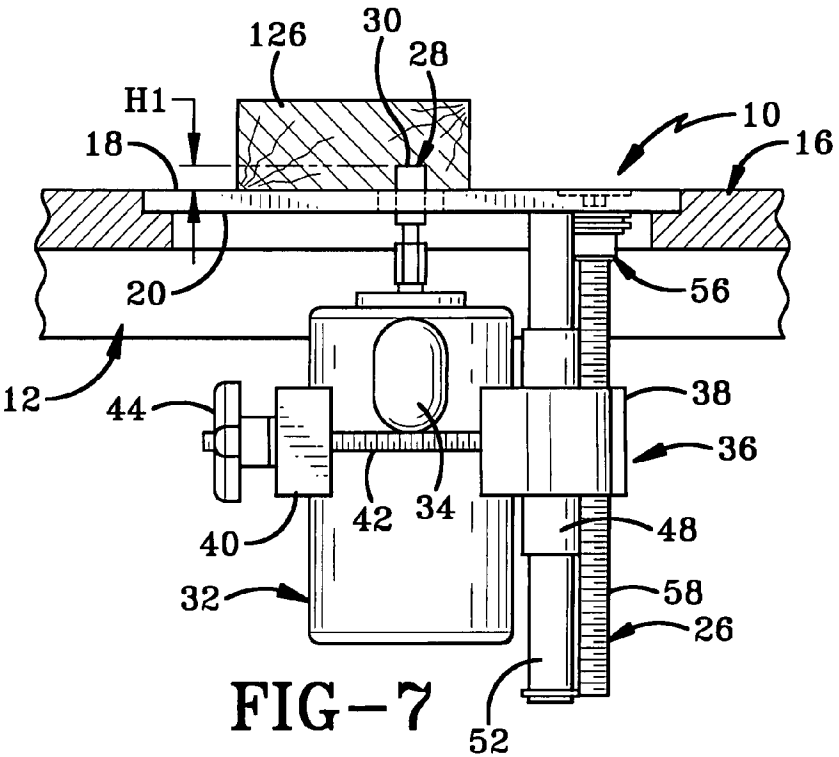
FIG. 7 is similar to FIG. 6 and shows a workpiece on the router table being cut by the router bit at the first height.
Figure 9:
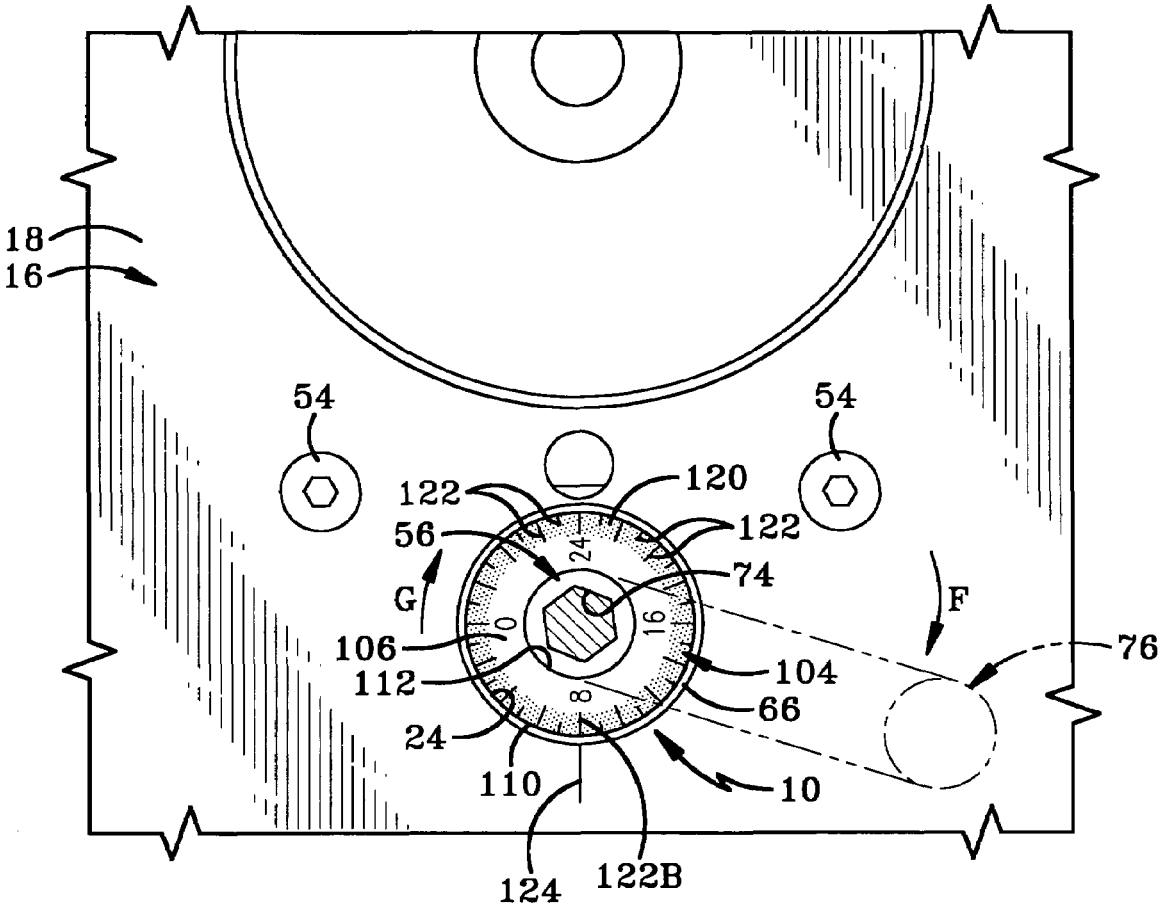
FIG. 9 is similar to FIG. 5 and shows the handle further rotating the adjustment screw and the adjustable scale so that another marking thereon is aligned with the reference mark.
Figure 11:
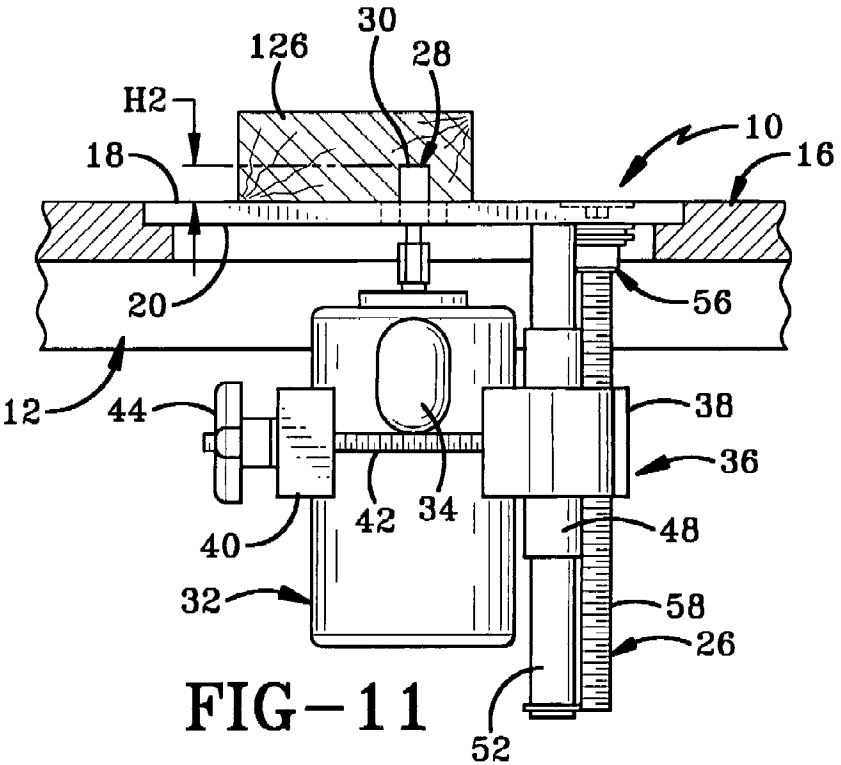
FIG. 11 is similar to FIG. 7 and shows the workpiece being cut with the router bit at the second height.
Figure 10:
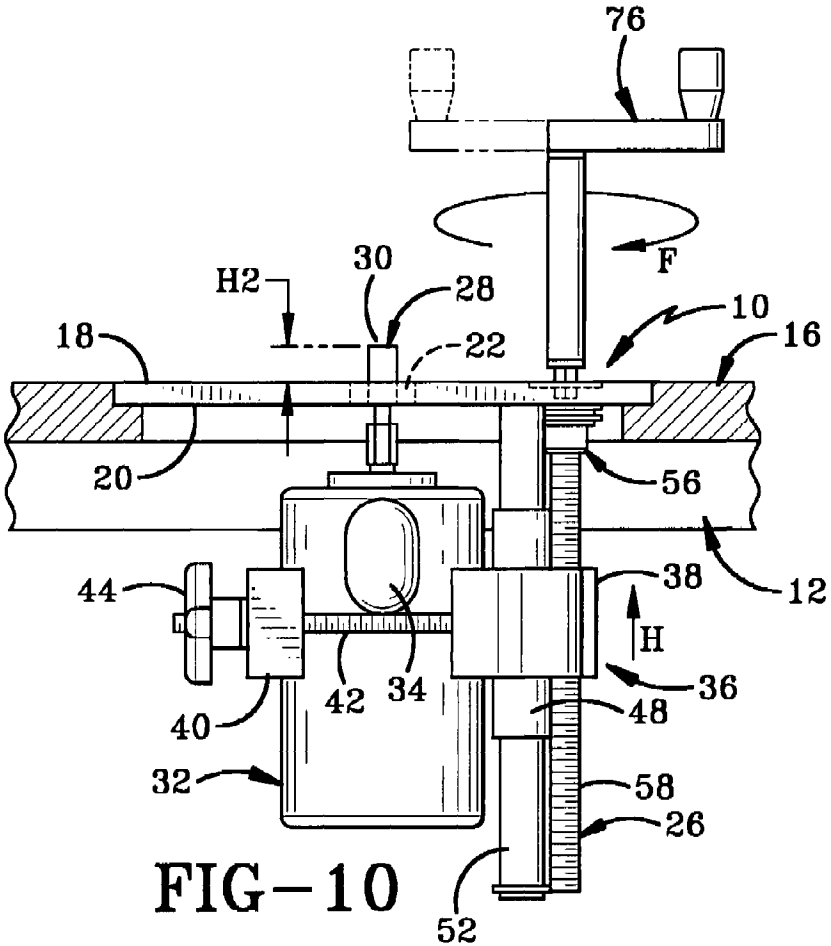
FIG. 10 is similar to FIG. 6 and shows the handle rotating the adjustment screw to raise the height of the router and cutter bit to a second height.

As shown in FIG. 7, router 32 is operated so that cutter bit 28 cuts a workpiece 126 while at first height H1. After this cut has been made and referring to FIG. 8, a force is manually applied as indicated at Arrow D to upper surface 106 of marker 104 to rotate marker 104 as indicated at Arrows E relative to cap 56 in order to align the "0" marking 122A with mark 124. Marker 104 has thus been reset to a zero position while cutter bit 28 is at first height H1. Referring to FIGS. 9-10, handle 76 is then rotated as indicated at Arrow F to rotate adjustment screw 26 and marker 104 together as indicated at Arrow G to raise carriage 36, router 32 and cutter bit 28 so that upper surface 30 thereof has moved to a second height H2. More particularly, marker 104 has been rotated from the position shown in FIG. 8 with marking 122A aligned with mark 124 to the position shown in FIG. 9 with the "8"

marking 122B aligned with mark 24, thus indicating that upper surface 30 of bit 28 has been moved 8/1000 of an inch from height H1 to height H2. As shown in FIG. 11, router bit 28 then cuts workpiece 126 when disposed at height H2. Adjustable scale 10 thus greatly facilitates the ability to track the change in height of a cutting member when moved from any particular height as represented by height H1 to any other height as represented by height H2.

It will be appreciated by one skilled in the art that various changes may be made within the scope of the present invention. For example, it will be understood that the plurality of markings shown on marker 104 may be disposed on the work surface of table plate 16 while a single mark may be located on a marker similar to marker 104. In addition, it will be understood that a marker may be mounted directly on table plate 16 in a recess formed therein so that such a marker is rotatably mounted on the table plate and out of contact with the adjustment screw, thus still allowing for the relative rotation of such a marker and the adjustment screw wherein the adjustment screw would include a mark or marking alignable with such a marker. In addition, it will be evident that the adjustable scale of the present invention may be used in other settings although it is most preferably used with a router or another rotary cutter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a first table plate member defining a through hole adapted to receive a rotary cutting member of a rotary cutter;

a first threaded member rotatably mounted on the table plate member;

a carriage which is adapted to carry the rotary cutter and which threadedly engages the first threaded member and is movable toward or away from the table plate member in response to rotation of the first threaded member;

a marker;

a marker carrier which carries the marker and is one of the first table plate member and the first threaded member;

a non-carrying member which is the other of the first table plate member and the first threaded member; the marker selectively rotatable relative to the marker carrier and non-carrying member;

a reference mark on one of the marker and the non-carrying member;

a plurality of markings on the other of the marker and the non-carrying member; and wherein the first threaded member and the marker are rotatable about a common axis.

2. The apparatus of claim 1 wherein the marker defines an opening in which a portion of the first threaded member is disposed.

3. The apparatus of claim 2 wherein the portion comprises a tool-engageable portion adapted to be engaged by a tool for rotating the first threaded member.

4. An apparatus comprising:

a first table plate member defining a through hole adapted to receive a rotary cutting member of a rotary cutter;

a first threaded member rotatably mounted on the table plate member;

a carriage which is adapted to carry the rotary cutter and which threadedly engages the first threaded member and is movable toward or away from the table plate member in response to rotation of the first threaded member;

a marker;

a marker carrier which carries the marker and is one of the first table plate member and the first threaded member;

a non-carrying member which is the other of the first table plate member and the first threaded member; the marker selectively rotatable relative to the marker carrier and non-carrying member;

a reference mark on one of the marker and the non-carrying member;

a plurality of markings on the other of the marker and the non-carrying member;

a frictional engagement member abutting the marker and the marker carrier.

5. The apparatus of claim 4 wherein one of the marker and the marker carrier defines a recess in which the frictional engagement member is disposed.

6. The apparatus of claim 4 wherein the marker defines an inner circumference; the first threaded member defines an outer circumference disposed within the inner circumference; and the frictional engagement member is disposed between the inner and outer circumferences.

7. An apparatus comprising:

a first table plate member defining a through hole adapted to receive a rotary cutting member of a rotary cutter;

a first threaded member rotatably mounted on the table plate member;

a carriage which is adapted to carry the rotary cutter and which threadedly engages the first threaded member and is movable toward or away from the table plate member in response to rotation of the first threaded member;

a marker;

a marker carrier which carries the marker and is one of the first table plate member and the first threaded member;

a non-carrying member which is the other of the first table plate member and the first threaded member; the marker selectively rotatable relative to the marker carrier and non-carrying member;

a reference mark on one of the marker and the non-carrying member;

a plurality of markings on the other of the marker and the non-carrying member;

an annular member abutting the marker and the marker carrier.

8. The apparatus of claim 7 wherein the annular member comprises an elastomeric material.

9. The apparatus of claim 7 wherein one of the marker and the marker carrier slidably engages the annular member during rotation of the marker relative to the marker carrier.

10. The apparatus of claim 7 wherein one of the marker and the marker carrier defines an annular groove in which the annular member is disposed.

11. The apparatus of claim 10 wherein the other of the marker and the marker carrier defines an annular groove in which the annular member is disposed.

12. The apparatus of claim 1 wherein one of the first table plate member and first threaded member defines an annular recess in which the marker is disposed.

13. An apparatus comprising:

a first table plate member defining a through hole adapted to receive a rotary cutting member of a rotary cutter;

a first threaded member rotatably mounted on the table plate member;

a carriage which is adapted to carry the rotary cutter and which threadedly engages the first threaded member and is movable toward or away from the table plate member in response to rotation of the first threaded member;

a marker;

a marker carrier which carries the marker and is one of the first table plate member and the first threaded member;

a non-carrying member which is the other of the first table plate member and the first threaded member; the marker selectively rotatable relative to the marker carrier and non-carrying member;

a reference mark on one of the marker and the non-carrying member;

a plurality of markings on the other of the marker and the non-carrying member;

wherein the first threaded member comprises a shaft and a flange extending radially outwardly therefrom; and the marker is disposed atop the flange.

14. The apparatus of claim 13 wherein the through hole in the first table plate member comprises a counterbore portion in which the flange is disposed.

15. The apparatus of claim 14 wherein the first table plate member comprises a flange bounding the counterbore portion; and further comprising a washer disposed between the flanges.

16. The apparatus of claim 1 wherein the first table plate member comprises a first side having a flat outer work surface; the through hole extends inwardly from the work surface; the first threaded member is disposed in the hole; and the marker is manually accessible from the first side of the first table plate member and disposed entirely inwardly of the work surface.

17. The apparatus of claim 1 further comprising the rotary cutter.

18. The apparatus of claim 17 further comprising the rotary cutting member; and wherein the first table plate member has first and second opposed sides; the first side has a work surface adapted to be contacted by a workpiece; the through hole extends from the first side to the second side; and the rotary cutting member rotatably is disposed in the through hole and projects outwardly of the work surface.

19. The apparatus of claim 1 wherein the marker slidably engages the threaded member during rotation of the marker relative to the threaded member.

20. The apparatus of claim 1 further comprising an upwardly facing surface on the marker carrier; and a downwardly facing surface on the marker which slidably engages the upwardly facing surface during rotation of the marker relative to the marker carrier.

21. The apparatus of claim 2 wherein the portion of the first threaded member is an upper portion; the first threaded member defines an annular recess circumscribing the upper portion; and the marker is disposed in the annular recess with the upper portion within the opening.

22. The apparatus of claim 21 further comprising a top surface on the upper portion; and a tool-receiving opening formed in the first threaded member extending downwardly from the top surface and adapted to receive therein a mating portion of a tool for rotating the first threaded member; and wherein the annular recess circumscribes the tool-receiving opening.

23. The apparatus of claim 22 in combination with the tool; and wherein the tool comprises a mating portion receivable in the tool-receiving opening which engages the first threaded member so that the first threaded member rotates in response to rotation of the tool.

24. The apparatus of claim 4 wherein one of the marker and marker carrier has an inner circumference which faces radially inwardly and defines a first groove which opens radially inwardly; the one of the marker and marker carrier comprises a first lip which extends radially inwardly and overhangs the first groove; and the frictional engagement member is disposed in the first groove beneath the first lip.

25. The apparatus of claim 24 wherein the other of the marker and marker carrier has an outer circumference which faces radially outwardly and defines a second groove which opens radially outwardly; the other of the marker and marker carrier comprises a second lip which extends radially outwardly and overhangs the second groove; and the frictional engagement member is disposed in the second groove beneath the second lip.

26. The apparatus of claim 4 wherein one of the marker and marker carrier has an outer circumference which faces radially outwardly and defines a groove which opens radially outwardly; the one of the marker and marker carrier comprises a lip which extends radially outwardly and overhangs the groove; and the frictional engagement member is disposed in the groove beneath the lip.

27. The apparatus of claim 26 wherein the groove and frictional engagement member are annular; and the frictional engagement member is formed of a stretchable and retractable material whereby the frictional engagement member is stretchable over the lip and retractable into the groove.

28. The apparatus of claim 4 wherein the frictional engagement member is the only structure extending from the marker to the marker carrier for mounting the marker on the marker carrier.

29. The apparatus of claim 28 further comprising a first groove formed in the marker; and a second groove formed in the marker carrier; and wherein the frictional engagement member is disposed in the first and second grooves.

30. The apparatus of claim 12 wherein the first threaded member defines the annular recess in which the marker is disposed.

31. An apparatus comprising:

a table plate defining a through hole adapted to receive a rotary cutting member of a rotary cutter;

a threaded member rotatably mounted on the table plate member;

a carriage which is adapted to carry the rotary cutter and which threadedly engages the threaded member and is movable toward or away from the table plate member in response to rotation of the threaded member;

a marker carried by and selectively rotatable relative to the threaded member;

a reference mark on one of the marker and the table plate;

a plurality of markings on the other of the marker and the table plate.

32. The apparatus of claim 30 wherein the marker slidably engages the threaded member during rotation of the marker relative to the threaded member.

* * * * *